US008232494B2

(12) United States Patent
Purcocks

(10) Patent No.: US 8,232,494 B2
(45) Date of Patent: Jul. 31, 2012

(54) KEYBOARD

(76) Inventor: Dale McPhee Purcocks, Blackrock (IE)

( * ) Notice: Subject to any disclaimer, the term of this patent is extended or adjusted under 35 U.S.C. 154(b) by 921 days.

(21) Appl. No.: 12/097,608

(22) PCT Filed: Dec. 12, 2006

(86) PCT No.: PCT/IB2006/003560

§ 371 (c)(1),
(2), (4) Date: Jul. 11, 2008

(87) PCT Pub. No.: WO2007/069026

PCT Pub. Date: Jun. 21, 2007

(65) Prior Publication Data

US 2008/0264770 A1 Oct. 30, 2008

(30) Foreign Application Priority Data

Dec. 16, 2005 (GB) ..... 0525605.2

(51) Int. Cl.
*H01H 13/14* (2006.01)

(52) U.S. Cl. ..... 200/521; 335/205

(58) Field of Classification Search ..... 200/521
See application file for complete search history.

(56) References Cited

U.S. PATENT DOCUMENTS

| | | | | |
|---|---|---|---|---|
| 3,681,723 | A | 8/1972 | Goll | |
| 4,018,999 | A * | 4/1977 | Robinson et al. | 200/5 A |
| 4,054,944 | A * | 10/1977 | Lau | 335/207 |
| 4,068,202 | A | 1/1978 | Lyons | |
| 5,977,888 | A | 11/1999 | Fujita et al. | |
| 7,667,623 | B2 * | 2/2010 | Soh et al. | 341/22 |
| 2002/0075108 | A1 | 6/2002 | Ward et al. | |

FOREIGN PATENT DOCUMENTS

| | | |
|---|---|---|
| EP | 1168234 | 1/2002 |
| GB | 2099762 | 12/1982 |

* cited by examiner

*Primary Examiner* — Renee S Luebke
*Assistant Examiner* — Lheiren Mae Caroc
(74) *Attorney, Agent, or Firm* — Larson & Anderson, LLC

(57) ABSTRACT

A keyboard, wherein an opposing force generated between two magnet faces of the same polarity is used to return each key button to its original position after being pressed. As a result, the keyboard can be made capable of withstanding harsh environments while offering a satisfactory tactile response for the user.

17 Claims, 6 Drawing Sheets

KEYBOARD

The present invention relates generally to a computer keyboard, and more specifically to a keyboard having non-physical button actuation, allowing for an effective barrier between its keys and inner circuitry.

A keyboard comprises a plurality of 'switches' connected to a microprocessor that monitors the state of each switch and initiates a specific response in accordance to a change in the that state. The switches are arranged to form a key matrix, with one switch per corresponding key button on the user-face of the keyboard. The key matrix itself is generally a Printed Circuit Board (PCB) or membrane, that lies underneath an array of key buttons, with a break in the circuit directly under each key button. As such the key matrix is a number of open circuits, waiting to be 'closed' by the introduction of a bridging conductive element, thus allowing a small amount of current to flow through. The microprocessor monitors the key matrix for signs of continuity at any point on the array, and when finding such a closed circuit, compares the location of that circuit on the key matrix to the character map on its Read Only Memory (ROM) before outputting an appropriate signal.

A switch can be closed in a number of different ways, including the use of rubber domes (with a carbon element on the upper-inner face), metal contacts, a membrane, or foam elements, some of which will now be briefly explained.

One of the more popular switch technologies currently in use employs a rubber dome, whereby each key button is located over a small, flexible rubber dome with a hard carbon element at its center. When a key button is pressed, a plunger on the underside of the key button pushes down against the top face of the dome, causing the carbon element to move accordingly and so be pushed down onto a break in the circuit on the PCB directly beneath it and thus bridge the circuit. When the key is released, the rubber dome springs back to its original shape, thus forcing the key back to its initial position. It is also known to provide a three-layer membrane, two layers having elements of the key matrix with a separation layer therebetween. In this case, no carbon contact is required on the rubber dome. Instead, when a key is pressed and the rubber dome is compressed, a small rubber 'finger' protruding from the center of the dome pushes the three layers of the membrane together and bridges the circuit at that location.

Membrane switches are very similar in operation, although do not have separate keys. Instead, a single rubber sheet is utilised having prominent areas for key buttons. This provides for a keyboard capable of withstanding extreme conditions, but also one with almost no tactile response.

From these examples it is clear to see that there is a distinct tradeoff between the tactile response of a keyboard and its ability to withstand harsh environments, such as contact with fine dust or liquid.

It is therefore an object of the present invention to provide a keyboard that is capable of withstanding such harsh environments as fine dust or being submerged in liquid, whilst still offering a satisfactory tactile response.

In accordance with the present invention there is provided a switch comprising a key member disposed in an initial position relative to a key matrix, such that pressure applied to said key member causes an electrical contact to be made on said key matrix, wherein a first magnet is provided in or on or as said key member and a second magnet is provided such that like poles of said first and said second magnet are facing each other in spaced apart relation, said first and said second magnets being arranged and configured so as to create an opposing force therebetween that acts to return said key member towards said initial position when said applied force is removed.

Thus the above mentioned object is achieved by using the opposing force generated between two magnet faces of the same polarity to return a key button to its original position after being pressed.

Preferably, a key member comprises a keycap with a downwardly protruding plunger at its center and a plurality of downwardly protruding legs, wherein said downwardly protruding legs cooperate with a plurality of adjacent guide pillars, such that said key member may slidably move in two directions along a single axis.

Beneficially, the guide pillars are mounted upon a base, and said key matrix and said key member are disposed on opposite sides of said base.

Alternatively, said key member may comprise a keycap with a downwardly protruding plunger at its center, said plunger being slidably mounted within an upwardly protruding collar that projects from said base, such that the key member may slidably move in two directions along a single axis.

Preferably, the first magnet is disposed at a distal end of the plunger to the keycap.

Beneficially, the base is configured with an aperture that allows said first magnet to pass through said base upon said applied pressure, thereby causing said contact to be made on said key matrix. The second magnet is preferably disposed on the opposite side of said key matrix to said first magnet.

Preferably, a non-permeable isolation layer is provided between said base and said key matrix to inhibit the ingress of liquid or the like from said key member side to said key matrix side.

Beneficially, said key matrix may comprise a elastically deformable membrane and said key matrix is disposed behind said second magnet relative to said first magnet. The second magnet is preferably slidably mounted within a channel defined by a collar. Beneficially, said second magnet and said key matrix are arranged and configured such that pressure applied to said key member, which causes movement of said first magnet towards said second magnet, creates an opposing force therebetween sufficient to cause movement of said second magnet within said channel so as to apply pressure to and elastically deform said key matrix and cause electrical contact to be made. Preferably, said deformed key matrix acts to return said second magnet towards its initial position when said pressure applied to said key member is removed.

Preferably, a third magnet is provided on the opposite side of said key matrix to said second magnet, such that the like poles of said third and said second magnet are facing each other in spaced apart relation, said third and said second magnet being arranged and configured so as to create an opposing force therebetween that acts to return said second magnet towards its initial position when said applied pressure is removed.

These and other aspects of the present invention will be apparent from, and elucidated with reference to, the embodiments described herein.

Embodiments of the present will now be described, by way of example only, and with reference to the accompanying drawings in which.

Figure 4:
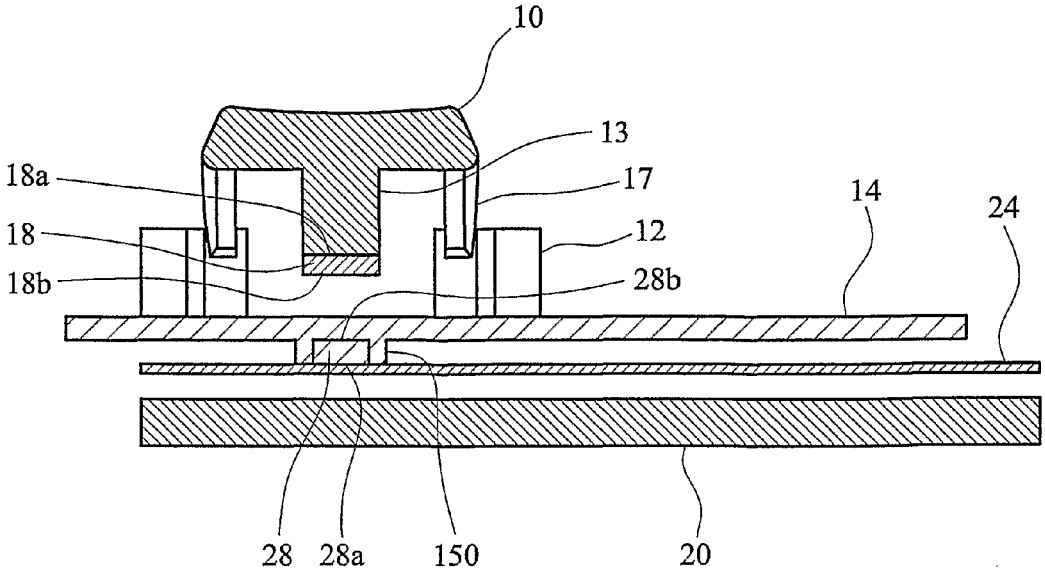
FIG. 4 is a schematic cross-sectional representation of a switch according to a third exemplary embodiment of the present invention.
Figure 5A:
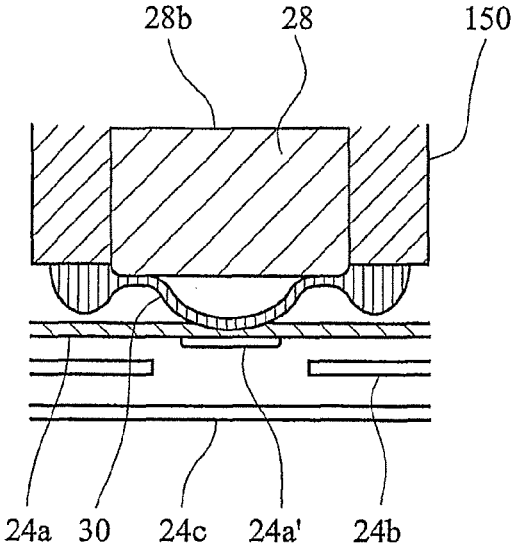
Figure 5B:
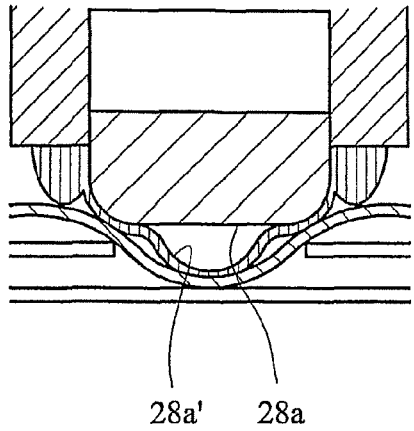
Figure 6:
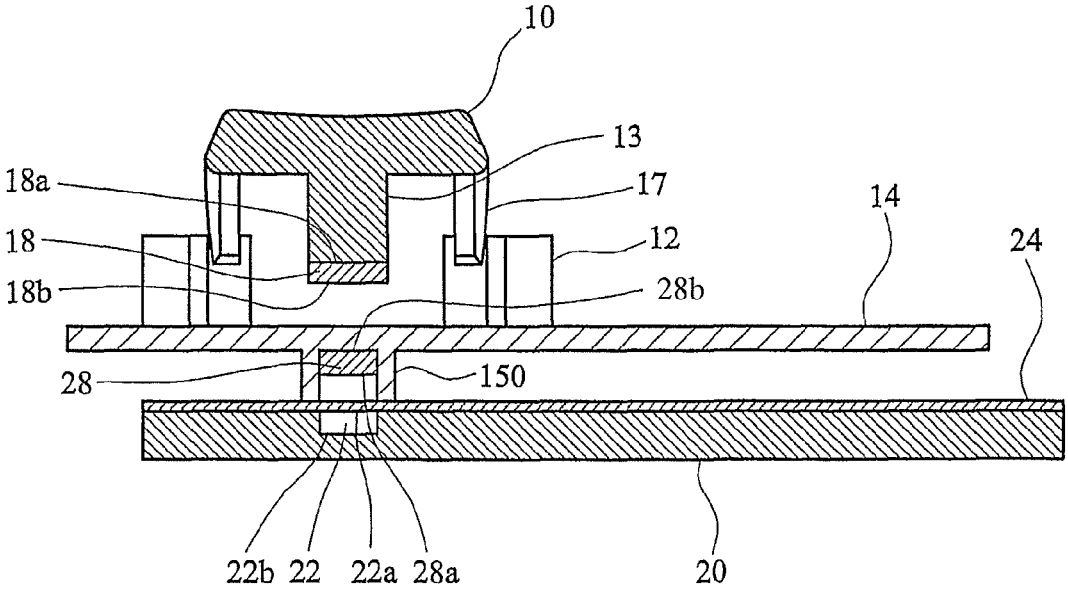
Figure 7A:
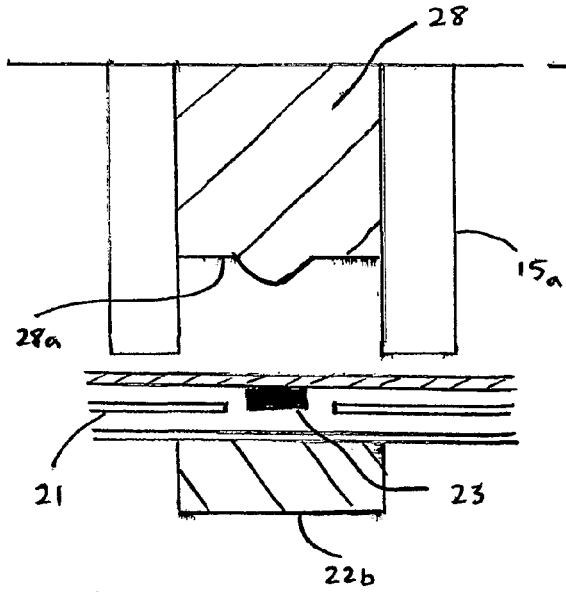
Figure 7B:
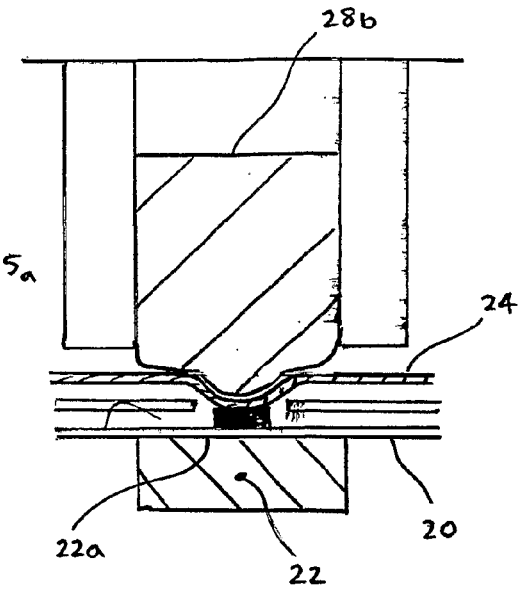
Figure 8A:
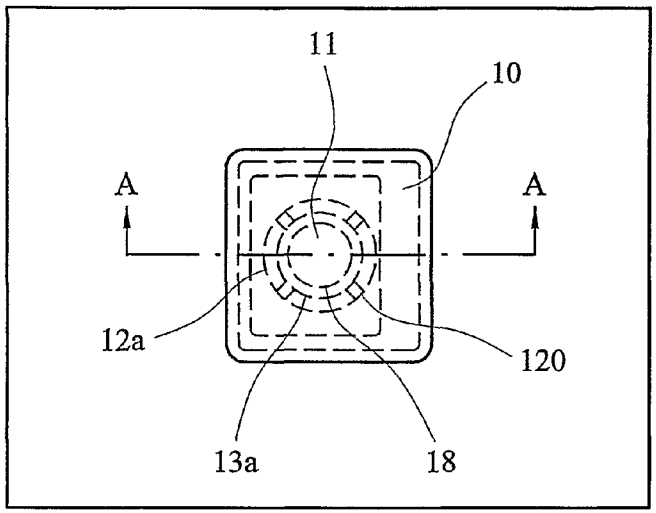
Figure 8B:
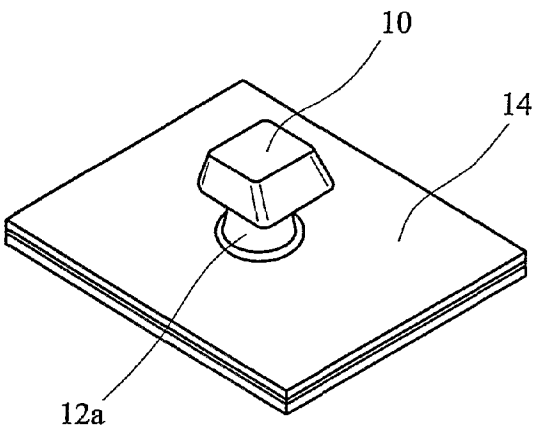
Figure 8C:
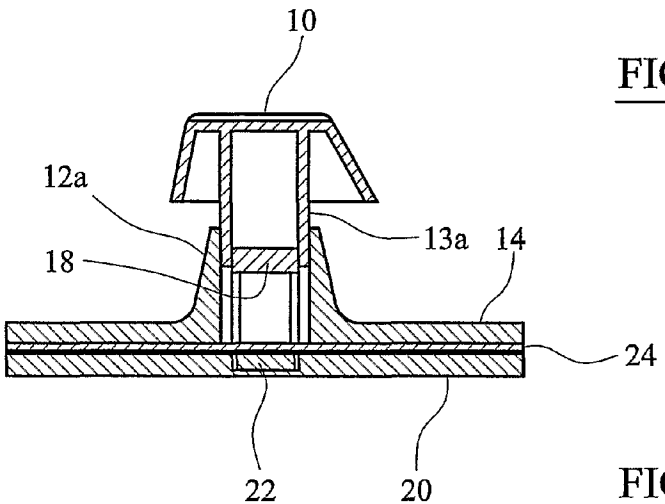
Figure 9B:
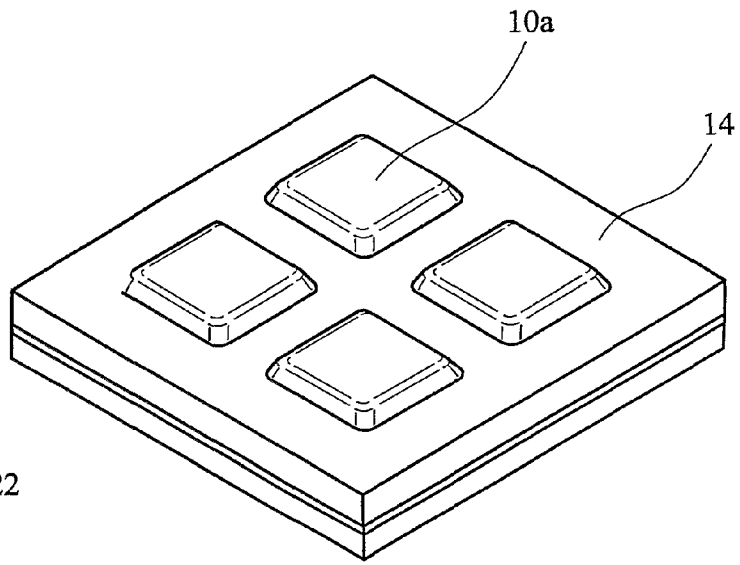
Figure 9A:
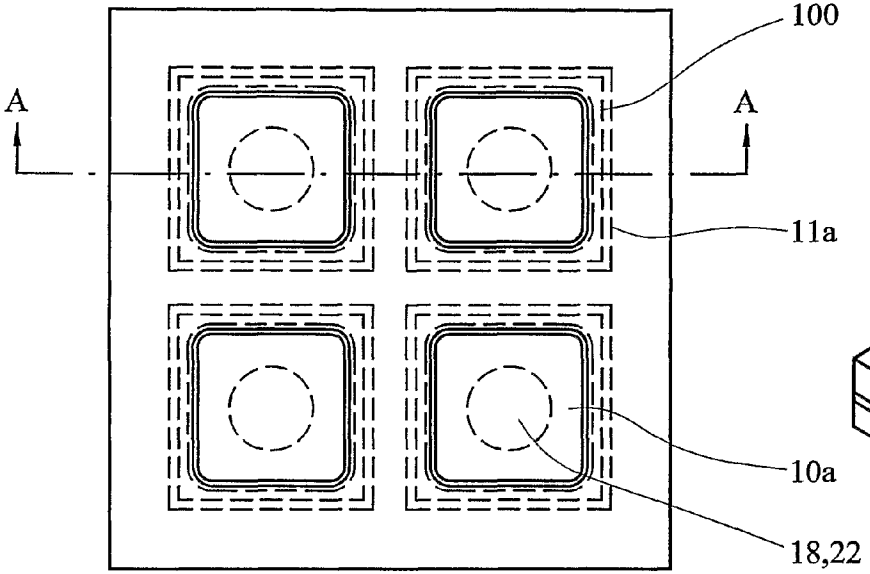
Figure 9C:
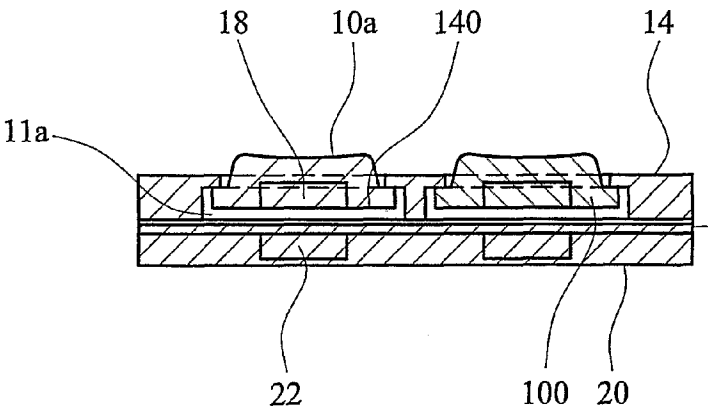

FIG. 5*a* is a schematic cross-sectional representation of the intermediate magnet of FIG. 4 in its initial position;

FIG. 5*b* is a schematic cross-sectional representation of the intermediate magnet of FIG. 4 when the switch is pressed;

FIG. 6 is a schematic cross-sectional representation of a switch according to a fourth exemplary embodiment of the present invention;

FIG. 7*a* is a schematic cross-sectional representation of the intermediate magnet and base magnet of FIG. 6 in its initial position;

FIG. 7*b* is a schematic cross-sectional representation of the intermediate magnet and base magnet of FIG. 6 when the switch is pressed;

FIG. 8*a* is a schematic plan-view representation of a switch according to a fifth exemplary embodiment of the present invention;

FIG. 8*b* is a schematic perspective representation of a switch according to a fifth exemplary embodiment of the present invention;

FIG. 8*c* is a schematic cross-sectional representation of a switch according to a fifth exemplary embodiment of the present invention;

FIG. 9*a* is a schematic plan-view representation of a switch according to a sixth exemplary embodiment of the present invention;

FIG. 9*b* is a schematic perspective representation of a switch according to a sixth exemplary embodiment of the present invention; and FIG. 9*c* is a schematic cross-sectional representation of a switch according to a sixth exemplary embodiment of the present invention.

Figure 1:
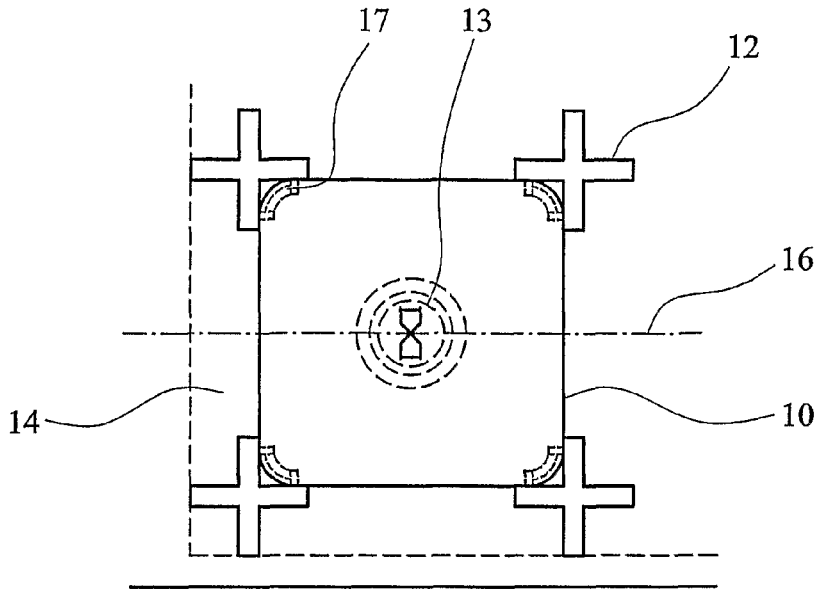
FIG. 1 is a plan-view schematic representation of a switch according to an exemplary embodiment of the present invention.

Referring to FIG. 1 of the accompanying drawings, a plan view schematic representation of a switch is shown. The switch comprises a keycap 10 having a generally central, hollow plunger 13, the end of which engages with the membrane 24 (or crown portion of a dome member in a dome switch arrangement), in use. Four, rigid, upwardly projecting guide pillars 12 extend from a base 14, which guide pillars 12 are equidistantly spaced around the plunger 13. The guide pillars 12 have a generally X-shaped cross-section, with substantially V-shaped guide rails or grooves being defined between the arms of the X. The keycap 10 further comprises a downwardly projecting leg 17 at each corner thereof, each leg 17 having a generally (rounded) L-shaped cross-section, the apex thereof being arranged and configured to co-operate with an inwardly facing guide rail defined by respective guide pillars 12.

In use, when a user presses the key, the plunger 13 moves downwards, contacting the membrane 24 and making complete the desired electrical circuit. As the key moves downwards, the legs 17 slide down along the respective guide rails 12. When the key is released, return means (in the following embodiments the return means is provided by the opposing force between a plurality of magnets) returns the keycap 10 to its original position and the electrical circuit is broken.

A center line 16 shown in FIG. 1, bisecting the keycap 10 laterally defines the plane from which the cross sections in FIGS. 2 to 7 are viewed.

Figure 2:
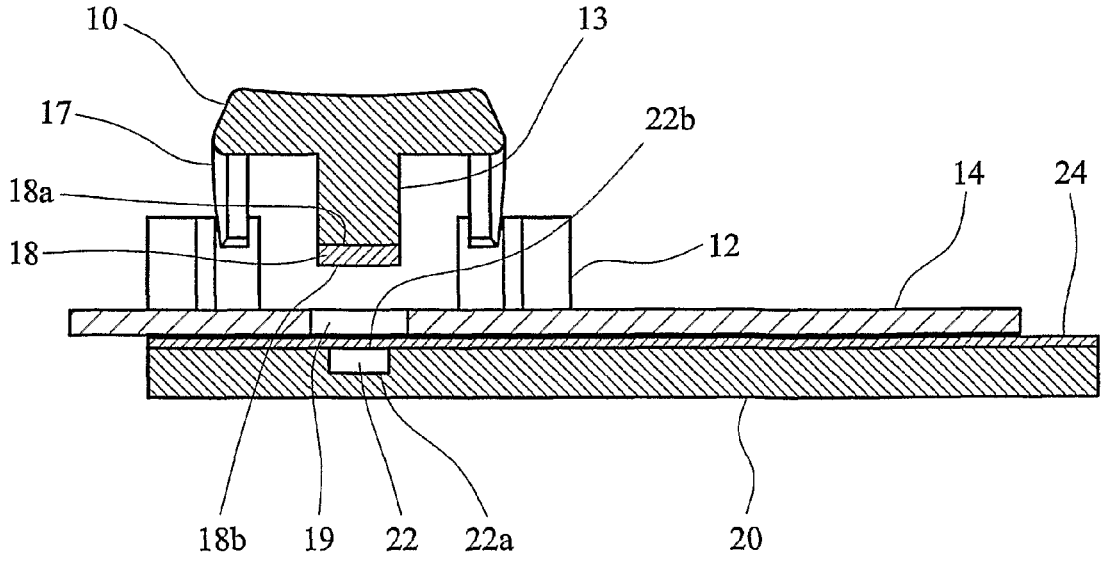
FIG. 2 is a schematic cross-sectional representation of a switch according to a first exemplary embodiment of the present invention.

Referring now to FIG. 2 of the accompanying drawings, a schematic cross-sectional view of a first exemplary embodiment of the present invention is shown, having a keycap 10 and guide pillars 12 as described above. The base 14 in this embodiment has an aperture 19 situated directly below the plunger 13, of a size large enough to let the plunger 13 pass through to beyond its lower face. Below the lower face of the base 14 is a membrane 24 that comprises three layers, a bridge level and a broken circuit level that co-operatively conduct when brought into contact, and a separation layer therebetween, as described above. The membrane 24 is substantially the same size and shape as that of the base 14 and contains an equal number of bridge areas as there are keys. The membrane 24 can be made from any durable yet flexible material, possibly polyester. A printed circuit is provided within the membrane 24 that contains the electrical elements to and from the switching elements (a switching element comprising a broken area of circuit and its corresponding conductive bridge area), such that when the plunger 13 passes through the aperture 19 in the base 14, it compresses the membrane 24 thereunder and forces the upper conductive bridge area to come into contact with the broken circuit area, thereby 'switching' at that location.

Situated within the support 20 are a plurality of lower magnets 22, that are positioned concentrically under an equal number of plunger magnets 18. A lower magnet 22 has a north 22*a* and a south 22*b* polarity and is orientated in a position of opposite polarity to that of the corresponding plunger magnet 18, such that they face each other with the same polarity faces (in this case south and south). It will be appreciated by a person skilled in the art that when two magnets of equal facing poles are brought together an opposing force results. This force is relative to the strength of the magnets magnetic field and thus can be tailored to a desired level of opposition in accordance with the choice of magnet.

In this exemplary embodiment, the keycap 10 is, by default, held in the position shown. It is held at this height above the base 14 by the opposing force generated between the south pole 18*b* of the plunger magnet 18 and the south pole 22*b* of the lower magnet 22. When a user presses the keycap 10, the applied force is greater than the opposing magnetic force and as such the key moves vertically downwards (so long as this applied force is present) until the bottom face of the legs 17 reach the top face of the base 14 (or a defined limit point therebetween). At this limit point the plunger 13 has passed through the aperture 19 in the base 14 and contacts the membrane 24 underneath it, thereby deforming the membrane 24 at this point and causing the conductive bridge area within the membrane 24 to bridge an associated broken point on the underlying printed circuit, and causing a 'switch' to occur. When a user removes his finger from a keycap 10, the applied force is removed and the opposing force of the magnets 18, 22 serve to return the keycap 10 to its initial position. Means may be provided to ensure the lower portion of the legs 17 of the keycap 10 do not rise higher than the height of the guide pillars 12.

Figure 3:
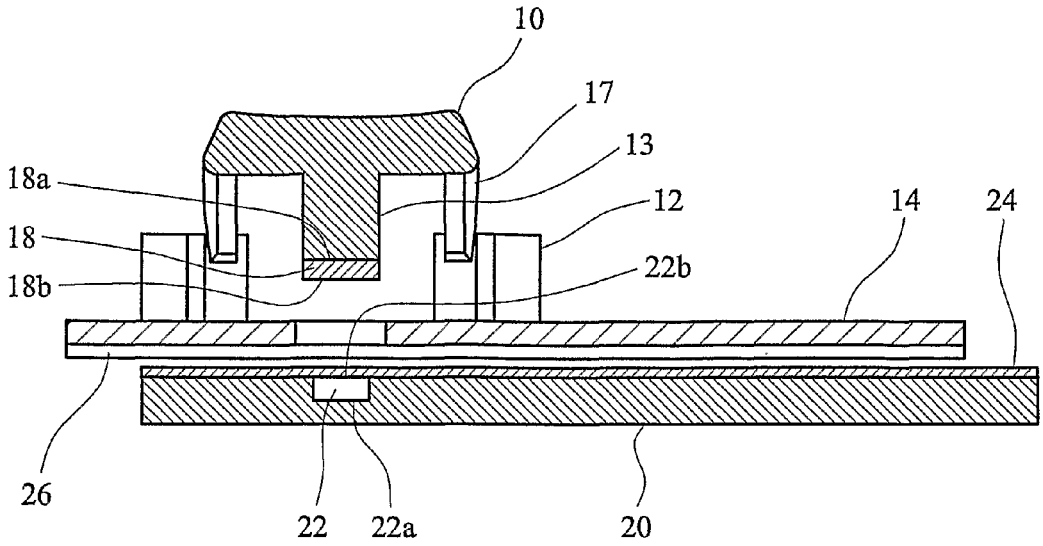
FIG. 3 is a schematic cross-sectional representation of a switch according to a second exemplary embodiment of the present invention.

Referring now to FIG. 3 of the accompanying drawings, a switch according to a second exemplary embodiment of the present invention is shown. This embodiment is in many respects substantially the same as that of the above-described first exemplary embodiment, and the elements are denoted by the same reference numerals. However, in this case an isolation layer 26 is provided between the base 14 and the membrane 24. The isolation layer 26 physically isolates the electronic components from the outside environment, enabling the keyboard to be submerged in liquid or be incident to fine dust or grit, without affecting the operational capacity of the keyboard. The isolation layer 26 can be made from any non-permeable material, preferably rubber, and may be provided with a series of protrusions to aid in the contact process.

Depending on the thickness/density of the rubber, the strength of the magnets may have to be optimised to provide the necessary opposing force.

Referring now to FIG. 4 of the accompanying drawings, a switch according to a third exemplary embodiment of the present invention is shown. In this embodiment the base 14 does not have an aperture, as in the previous embodiments, but is constructed of a single non-perforated sheet.

Protruding downwardly from the underside of the base 14 is a collar 150, defining an enclosure, in which is disposed an intermediate magnet 28. The intermediate magnet 28 has a south pole 28*b* facing upwards and a north pole 28*a* facing downwards, such that the south pole 28*b* is facing the south pole 18*b* of the plunger magnet 18. The intermediate magnet 28 is retained in its enclosure by the membrane 24, that will deform to some extent to allow the intermediate magnet 28 to protrude from the enclosure defined by the collar 150 (upon application of pressure to the keycap 10) to a degree necessary to perform its function.

The intermediate magnet 28 itself has one flat faced pole (whichever pole is facing the plunger magnet 18) and a contoured face. Referring now to FIG. 5*a*, the north pole 28*a* of the intermediate magnet 28 has a convex center 28*a*' that protrudes downwardly. This convex portion 28*a*' may be formed integrally with the magnet 28 but is more likely to comprise a 'sock' like member 30, provided over the magnet 28. The membrane 24 lying beneath acts against the convex portion 28*a*' provided on the magnet 28 to hold it in its enclosure when no other forces are indirectly applied by a user. Referring now to FIGS. 4 and 5*b*, when a user presses the keycap 10, it moves downwardly until the plunger magnet 18 reaches its limit point (which in this case is the top surface of the base 14). As the south pole 18*b* of the plunger magnet 18 is brought closer to the south pole 28*b* of the intermediate magnet 28, the intermediate magnet 28 will experience the above-mentioned opposing magnetic force and is forced against the membrane 24, which deforms to allow the magnet 28 to protrude from the enclosure. Within the membrane 24 is a restricting level 24*b* that has a plurality of apertures, each one situated below each intermediate magnet 28, that is large enough to allow the convex portion 28*a*' of the magnet 28 through, but not the shoulder parts, such that the convex portion 28*a*' can(to a degree) pass through the aperture and cause the conductive bridge area 24*a*' on the underside of the bridge level 24*a* to be brought into contact with the top surface of the printed circuit on the broken circuit level 24*c*. When a user removes his finger from the keycap 10, the opposing force between the magnets 18, 28 diminishes with their relative separation, resulting in the force applied to the magnet 28 by the deformed membrane 24 being greater than any opposing force from the plunger magnet 18 and thus the membrane 24 returning to its original shape, returning the intermediate magnet 28 to its initial position within the enclosure defined by the skirt section 150.

The magnets 18, 28 and membrane 24 must be chosen carefully to ensure that the opposing force and the return force provided by the membrane 24 are of defined magnitudes that permit functionality. Referring again to FIG. 4, in order for the keycap 10 to remain at rest as shown wherein the separation between the magnets 18, 28 is defined as X, the return force provided by the membrane 24 must be greater than the weight (i.e. the force acting on the combined mass) of the two magnets 18, 28, the keycap 10, legs 17 and plunger 13. Friction between the legs 17 and the guide pillars 12 is also taken into account. The opposing force at separation X should be greater than or equal to the return force provided by membrane, however when separation is reduced to ½×, the opposing force should be far greater than the return force provided by the membrane to ensure full actuation of the intermediate magnet 28 when the keycap 10 is pressed.

Referring now to FIG. 6, a fourth exemplary embodiment of the present invention is shown wherein the return force that was supplied by the membrane 24 (in the third embodiment) has been replaced by a second opposing force (between an intermediate magnet 28 and a lower magnet 22). As in the third embodiment, a keycap 10 is slidably mounted within four guide pillars 12 that are fixed to a non-perforated, non-permeable base 14. Protruding downwardly from the under side of the base 14 at a position in line with the plunger magnet 18 is a collar 150, that defines a deeper enclosure than the third embodiment. The collar 150 terminates in close proximity to the support, with a membrane 24 therebetween. A base magnet 22 is situated on or within the support 20, orientated to have the same pole facing up at the intermediate magnet 28 as that of the intermediate magnet 28 facing down at it.

Referring now additionally to FIGS. 7*a* and 7*b*, a user presses a key button 10 therefore decreasing the separation between the plunger magnet 18 on the bottom end of the plunger 13 and the intermediate magnet 28 situated within the enclosure on the far side of the base 14 (relative to it). As this separation decreases, so too the opposing force increases, causing the intermediate magnet 28 to slide down and contact the top face of the membrane 24. This moves the conductive bridge area 24*a*' on the underside of the bridge level 24*a* to be brought into contact with the top surface of the printed circuit on the broken circuit level 24*c* thereunder, thus completing the circuit (as is shown in FIG. 7*b*). When a user removes his finger from the key button 10, the separation between the plunger magnet 18 and the intermediate magnet 28 becomes greater until it reaches a point where the plunger-intermediate 18, 28 opposing force becomes less than the lower-intermediate 22, 28 opposing force and the intermediate magnet 28 thus moves in an upward direction, back into the enclosure (as is shown in FIG. 7*a*). It should be noted that although the magnet 28 in this embodiment is shown without a 'sock' like member 30 (a 'sock' like member 30 is present in FIGS. 5*a* and 5*b*), it may be provided in this or any other exemplary embodiment.

The advantage of this embodiment over the previous is that the intermediate magnet 28 is returned to its default position in the enclosure by way of a second opposing magnetic force, rather than relying on a return force produced by the deformed membrane 24. Over time it is possible that a membrane 24 being used in such a way will degrade and lose the ability to provide a consistent return force and could damage the inherent circuitry, leading to malfunction of the keyboard. This is not the case with the arrangement proposed in this embodiment. Providing that the plunger-intermediate 18,28 opposing force is greater than the base-intermediate 22, 28 opposing force, a switch will be made every time a key button 10 is pressed. Providing that the base-intermediate 22, 28 opposing force is greater than the weight component of the intermediate magnet 28, the plunger magnet 18 and the key button 10 (and its associated plunger), the intermediate magnet 28 will always return to its default position after a key button 10 is released. Providing the plunger-intermediate 18, 28 opposing force is greater (at separation X) than the weight component of the plunger magnet 18 and the key button 10 (and its associated plunger), the key button will always return to its default position once released.

Referring now to FIGS. 8*a*, 8*b* and 8*c* a schematic plan view, perspective view and cross-sectional representation of a switch are shown, respectively, according to fifth exemplary embodiment of the present invention. The switch comprises a keycap 10 having a generally central, hollow plunger 13*a* housing a plunger magnet 18 at a distal end to the keycap 10. A rigid, upwardly projecting guide collar 12*a* extends from a base 14, defining a cylindrical passageway 11, in which the plunger 13*a* is slidably mounted. The cylindrical passageway 11 further contains a number of vertically orientated guide channels 120 which communicate with ribs of substantially equal but opposite shape, provided on the plunger 13*a*, to restrict any rotation of the keycap 10 about a vertical axis.

As described above, a user presses the keycap 10, causing the plunger 13*a* to move downwardly within the guide collar 12*a* and so too the plunger magnet 18 mounted at its end. The magnet 18 contacts and deforms the membrane 24 thereunder, thereby causing a switch to occur. When the pressure applied to the keycap 10 is removed, the opposing force between the plunger magnet 18 and the lower magnet 22 acts to return the keycap 10 towards its initial position.

Referring now to FIGS. 9*a*, 9*b* and 9*c*, a schematic plan view, perspective view and cross-sectional representation of a switch are shown, respectively, according to sixth exemplary embodiment of the present invention. The switch comprises a keycap 10*a* that when viewed cross-sectionally (as FIG. 9*c*) is shorter than that of previous embodiments and has a lip 100 that runs around its perimeter (as viewed from FIG. 9*a*). The base 14 in this embodiment contains a plurality of substantially square shaped apertures of a size that permit the upper face of a keycap 10*a* to protrude through. The apertures, when viewed cross-sectionally, widen at a point as they get deeper, such to accommodate the lip 100 of a keycap 100*a* so that the aperture allows the top face of a keycap 10*a* to protrude from it, but will not allow the lip 100 to pass its upper 'neck' section 140, thereby restricting the keycap 10*a* from totally exiting the aperture. Provided on the underside of the keycap 10*a* is a plunger magnet 18 that deforms the membrane 24 when the keycap 10*a* is incident to pressure applied by a user. Just as in the above embodiments, the keycap 10*a* is returned towards its initial position (when a user removes the pressure applied top the keycap) by the opposing force generated between the two like poles of the plunger magnet 18 and the lower magnet 22.

The switch architectures of the fifth and sixth exemplary embodiments may be used in any of the preceding embodiments, providing the number of magnets and magnet arrangement are provided accordingly.

It will now be apparent to the skilled reader that by using magnets to actuate the return force switching, within the keyboard, it is possible to create a far more efficient barrier between the keys on the outside and the circuitry within, without loss of functionality. This results in the ability to provide a keyboard that can be completely submerged in liquid without damage to the electronics therein, as well as continue to function even in the harshest, dustiest environments. Even though there is no physical coupling between the button and the membrane, there is still a good tactile response, enabled by the opposing force between the moving magnets.

It should be noted that the above-mentioned embodiment illustrates rather than limits the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. The singular reference of an element does not exclude the plural reference of such elements and vice-versa. The invention may be implemented by means of hardware comprising several distinct elements. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. A switch comprising:

a key member disposed in an initial position relative to a key matrix, such that pressure applied to said key member causes an electrical contact to be made on said key matrix, wherein a first magnet is provided in or on or as said key member;

a second magnet is provided which is disposed in an initial position and arranged such that like poles of said first and said second magnet are facing each other in spaced apart relation, said first and said second magnets being arranged and configured so as to create an opposing force therebetween that acts to return said key member towards said initial position when said applied pressure is removed; and a third magnet is provided on the opposite side of said key matrix to said second magnet such that like poles of said third and said second magnets are facing each other in spaced apart relation, said third and said second magnets being arranged and configured so as to create a second opposing force therebetween that acts to return said second magnet towards its initial position when said applied pressure is removed.

2. A switch according to claim 1, wherein said key member comprises a keycap with a downwardly protruding plunger at its center, said plunger being slidably mounted such that said key member may slidably move in two directions along a single axis.

3. A switch according to claim 2, wherein said key matrix and said key member are disposed on opposite sides of a base.

4. A switch according to claim 3, wherein said first magnet is disposed at a distal end of said plunger to said keycap.

5. A switch according to claim 4, wherein said base is configured with an aperture that allows said first magnet to pass through said base upon said applied pressure, thereby causing said electrical contact to be made on said key matrix.

6. A switch according to claim 5, wherein said second magnet is disposed on the opposite side of said key matrix to said first magnet.

7. A switch according to claim 6, wherein a non-permeable isolation layer is provided between said base and said key matrix to inhibit the ingress of liquid or the like from said key member side to said key matrix side.

8. A switch according to claim 1, wherein said key matrix is disposed behind said second magnet relative to said first magnet.

9. A switch according to claim 8, wherein second magnet is slidably mounted within a channel defined by a collar.

10. A switch according to claim 9, wherein said second magnet and said key matrix are arranged and configured such that pressure applied to said key member, which causes movement of said first magnet towards said second magnet, creates an opposing force therebetween sufficient to cause movement of said second magnet within said channel so as to apply pressure to and elastically deform said key matrix and cause electrical contact to be made.

11. A switch according to claim 10, wherein said deformed key matrix acts to return said second magnet towards its initial position when said pressure applied to said key member is removed.

12. A switch comprising:

a key member disposed in an initial position relative to a key matrix, such that pressure applied to said key member causes an electrical contact to be made on said key matrix, wherein a first magnet is provided in or on or as said key member; and a second magnet is provided such that like poles of said first and said second magnet are facing each other in spaced apart relation, said first and said second magnets being arranged and configured so as to create an opposing force therebetween that acts to return said key member towards said initial position when said applied force is removed, wherein said key member comprises a keycap with a downwardly protruding plunger at its center, said plunger being slidably mounted such that said key member may slidably move in two directions along a single axis, wherein said key matrix and said key member are disposed on opposite sides of a base, wherein said first magnet is disposed at a distal end of said plunger to said keycap, and wherein said key matrix comprises an elastically deformable membrane.

13. A switch according to claim 12, wherein said key matrix is disposed behind said second magnet relative to said first magnet.

14. A switch according to claim 12, wherein said second magnet is slidably mounted within a channel defined by a collar.

15. A switch according to claim 12, wherein said second magnet and said key matrix are arranged and configured such that pressure applied to said key member, which causes movement of said first magnet towards said second magnet within said channel so as to apply pressure to and elastically deform said key matrix and cause electrical contact to be made.

16. A switch according to claim 15, wherein said deformed key matrix acts to return said second magnet towards its initial position when said pressure applied to said key member is removed.

17. A switch according to claim 12, wherein a third magnet is provided on the opposite side of the key matrix to said second magnet such that like poles of said third and said second magnets are facing each other in spaced apart relation, said third and said second magnets being arranged and configured so as to create a second opposing force therebetween that acts to return said second magnet towards its initial position when said applied force is removed.

* * * * *